US006785116B1

(12) United States Patent
Hummel et al.

(10) Patent No.: US 6,785,116 B1
(45) Date of Patent: Aug. 31, 2004

(54) TRIGGERING UNIT CONTROLLED BY A MICROPROCESSOR FOR INITIATING PYROTECHNICAL ELEMENTS

(75) Inventors: Dirk Hummel, Haltern (DE); Jan Petzold, Rösrath (DE); Heinz Schäfer, Lilienthal (DE); Ulrich Steiner, Troisdorf (DE); Andreas Zemla, Much (DE)

(73) Assignee: Orica Explosives Technology PTY Limited, Melbourne (AT)

( * ) Notice: Subject to any disclaimer, the term of this patent is extended or adjusted under 35 U.S.C. 154(b) by 0 days.

(21) Appl. No.: 10/071,000

(22) PCT Filed: Sep. 12, 2000

(86) PCT No.: PCT/EP00/08897

§ 371 (c)(1),
(2), (4) Date: Jul. 8, 2002

(87) PCT Pub. No.: WO01/23827

PCT Pub. Date: Apr. 5, 2001

(30) Foreign Application Priority Data

Sep. 27, 1999 (DE) ..... 199 46 291
Apr. 8, 2000 (DE) ..... 100 17 703

(51) Int. Cl.[7] ..... G01V 1/06

(52) U.S. Cl. ..... 361/247; 361/249; 361/253; 361/254; 361/261

(58) Field of Search ..... 361/247, 249, 361/254, 253, 256, 261, 264, 266, 103, 104, 154, 156, 168.1, 191, 58, 119, 120, 182, 280; 363/57, 86

(56) References Cited

U.S. PATENT DOCUMENTS 4,904,996 A * 2/1990 Fernandes
5,261,483 A * 11/1993 Imaoka
5,932,979 A * 8/1999 Sun
6,175,302 B1 * 1/2001 Huang

* cited by examiner

*Primary Examiner*—Dean A. Reichard
*Assistant Examiner*—Nguyen T. Ha
(74) *Attorney, Agent, or Firm*—Antonelli, Terry, Stout & Kraus, LLP

(57) ABSTRACT

A triggering unit for initiating pyrotechnical elements includes a control component, a rectifier (12), an energy store (15), a voltage regulator (13), a data coupling device (11), a current limiter and a suppressor circuit (10). To enable an up to now unknown variety of variants pertaining to characteristics and functionality without having to change the hard ware or the design of the chip, the control component is a programmable microprocessor (10) with an integrated program memory.

18 Claims, 1 Drawing Sheet

TRIGGERING UNIT CONTROLLED BY A MICROPROCESSOR FOR INITIATING PYROTECHNICAL ELEMENTS

BACKGROUND OF THE INVENTION

The invention relates to a triggering unit for initiating pyrotechnic elements and to a method for operating this triggering unit.

Pyrotechnic elements are taken to mean all elements which trigger a pyrotechnic effect owing to the application of an electrical voltage, preferably in conjunction with coded signals, the effect having a desired result, for example the ignition of an explosive charge, triggering of a gas generator, an air bag, the ignition of large fireworks or sprinkler units and fire extinguishers. Therefore, pyrotechnic elements include inter alia igniters, in particular detonators for civil and high security sectors (automotive, military and oil field), ignition elements, belt tighteners and gas generators.

All electronic igniters known on the market consist in the triggering unit of the components: control module (customised chip), rectifier, energy store, voltage regulator, data coupler, current limiter and suppressor circuit.

The logic or the sequencing control is provided by a control module specially developed for an application and therefore predetermining its function-specific properties by its control logic, converted in the chip structure. Each change in the logic or the function requires redesigning of the chip. Such redesigning is coupled with high costs and time expenditure as in most cases it is necessary to change the complete masking set. The remaining peripherals (rectifier, energy store, voltage regulator, data coupler, current limiter etc.) are generally unaffected during redesigning.

DISCLOSURE OF THE INVENTION

The object of the invention is to introduce an electronic triggering unit for initiating pyrotechnic elements with a control component, a rectifier, an energy store, a voltage regulator, a data coupler, a current limiter and suppressor circuit, which triggering unit makes possible a hitherto unknown variety of properties and functionality without changes in the hardware or the chip design being necessary.

This object is achieved by using a standard microprocessor with integrated programme memory as control component loaded with a programme corresponding to current requirements during production or at least before the triggering unit is used.

Any desired type of electronic triggering unit can be produced using this principle without changes in the hardware having to be made (design and structure of the electronic triggering/control device).

It is possible to produce all conceivable electronic triggering units, such as for detonators, air bags etc., on a production plant without having to intervene in the production sequence as the respective triggering characteristic is determined exclusively by the software (programme) loaded into the triggering unit.

A processor based electronic triggering unit can therefore emulate all systems known on the market.

A plurality of systems may even be combined in one programme depending on the programme memory capacity. This triggering unit can then independently detect which properties it is to assume with the aid of the control signals. A further advantage consists in the fact that any programmable microprocessors can be used. Therefore, dependence on a single supplier or chip manufacturer is done away with.

In addition to many other features, the microprocessor used according to the invention has an internal oscillator which can preferably be calibrated by software, a writable programme memory, a data memory, data inputs and outputs and a switching output. A data coupler, a rectifier, a voltage regulator and an energy store are required as peripheral components. It is also conceivable for these peripheral components to be integrated completely or partially in the microprocessor.

The use of this invention also realises a large number of possibilities which cannot be achieved using conventional chip technologies. These include, for example:

Implementing customised requests, such as special security removal sequences etc.

Microprocessor technology is so far advanced that, in the meantime, internet-ready single chip microprocessors comprising all interfaces and protocols for use on the internet are obtainable commercially. When using a microprocessor of this type, the electronic triggering device can be connected directly to the internet by appropriate software in the former and can function in response to the appropriate security codes. Therefore, for example an explosion in Germany which is monitored, checked and triggered via the internet from Australia is conceivable using this technology.

Supplementary safety features, such as automatic deactivation or ignitions with specific, person-based identification (ID) only are possible.

Time stage-dependent (inputting fixed addresses) and triggering units freely programmable in time or interval.

Emulating systems already on the market with the advantages:

no retraining of staff existing ignition systems can be taken on.

Further advantages:

Only one legally stipulated authorisation for one system. This authorisation can be transferred to all further systems (plurality of systems).

Flexible voltage level and signal codes.

Production and delivery of unprogrammed triggering units (blanks). The customer has the opportunity to create his own system as required.

As microprocessors are predominantly produced for automotive sectors, there is an expanded temperature range not normally produced in customised chips. This property can be exploited without additional expenditure.

Triggering units known to us, such as detonators, are preferably produced using chip-on-board technology. This requires a lot of know-how in the production of the safety-relevant electronics, so they can only be produced by highly trained personnel. The product is made more expensive as a result. If a microprocessor accommodated as standard in a housing is used it can be assembled using SMD technology. This reduces the production costs as it is a widely used production technology which can be mastered across the world.

Owing to the use of microprocessors, rapid reaction to market demands is possible without hardware modifications. The market demand is converted by software and can go directly into production after it has been qualified by the company.

Owing to the use of microprocessors, a rapid reaction to new legal requirements is possible without hardware modifications. The requirement is converted by software and can go directly into production after it has been qualified by the company.

Owing to the use of microprocessors, rapid reaction to new safety regulations is possible without hardware modifications. The requirement is converted by software and can go directly into production after it has been qualified by the company.

BRIEF DESCRIPTION OF THE DRAWINGS

An embodiment of a triggering unit according to the invention is described hereinafter with the aid of a circuit diagram in FIG. 1.

DETAILED DESCRIPTION OF THE DRAWING

Figure 1:
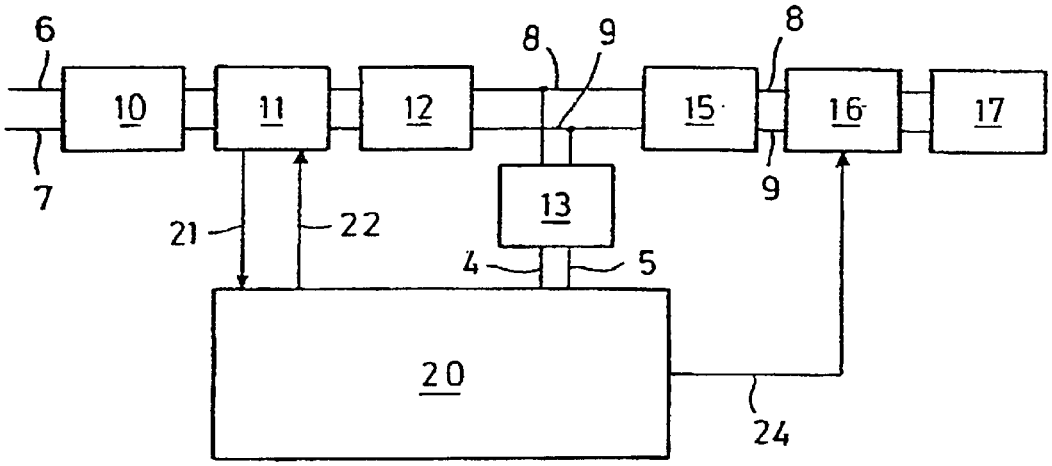

In the figure, the reference numerals represent the following elements:

6/7: input lines, in practice predominantly the electrical connection to a control unit.

10: suppressor circuit, for example in the form of series resistors or parallel resistors or voltage- and/or current-limiting semiconductor elements, arc-over sections etc.

11: data coupler for level-adjusted reading in of the information transmitted via 6/7 and for emitting (via 6/7) the information generated in the microprocessor 20.

12: rectifier, for unipolar operation of the electronics (no position-oriented assembly of the triggering units by the user required) and for rectifying the signals in the event that information is currently being transmitted via alternating voltage signals.

8/9: main current supply branch

13: voltage regulator, provides a generally constant voltage for the microprocessor 20.

20: microprocessor.

4/5: microprocessor current supply branch.

21: level-adjusted data input to microprocessor 20.

22: data output to data coupler 11.

24: trigger signal for initiating the ignition.

15: energy store, generally a capacitor, serves to supply current to the microprocessor 20 and to ignite the ignition element 17.

16: switching element for triggering the ignition element 17.

17: ignition element: EED (Electrical Explosive Device).

What is claimed is:

1. An electronic triggering unit for detonators with a control component, a rectifier (12), an energy store (15), a voltage regulator (13), a data coupler (11), a current limiter and a suppressor circuit (10), characterised in that the control component is a programmable microprocessor (20) with integrated programme memory, which is loaded with a programme corresponding to the current requirements during production of the triggering unit or at least before use thereof, the triggering characteristic of the triggering unit being determined by the programme to be loaded.

2. Triggering unit according to claim 1, characterised in that the microprocessor (20) comprises at least data inputs (21) and the data outputs (22) and a switching output (24), an oscillator.

3. Triggering unit according to claim 2, characterised in that the oscillator can be calibrated by software.

4. Method for operating a triggering unit having a control component, a rectifier (12), an energy store (15), a voltage regulator (13), a data coupler (11), a current limiter and a suppressor circuit (10), characterised in that the control component is a programmable microprocessor (20) with integrated programme memory, the method comprising loading the microprocessor with a programme corresponding to the current requirements during production of the triggering unit or at least before use thereof.

5. Method according to claim 4, characterised in that the triggering characteristic of the triggering unit is determined by the programme to be loaded.

6. Method according to claim 4, charactrerised in that the triggering characteristic of the triggering unit is determined according to the type of control.

7. Method according to claim 4, characterised in that the microprocessor (20) can also process internet protocols.

8. Method according to claim 4, characterised in that the operating software is implemented at random instants on an unprogrammed triggering unit or higher order subassembly (such as detonators).

9. Method according to claim 4, characterised in that the programming lines of the microprocessor are used as data inputs and outputs.

10. Method according to claim 4, characterised in that the switching output (24) can be reinforced by discrete components.

11. Method according to claim 4, characterised in that communication between the triggering unit and the ignition device can be uni- or bi-directional in a demand-driven manner.

12. Method according to claim 4, characterised in that the triggering unit and the ignition device can communication using various media, such as metallic conductor (cable), optical fibre, ultrasound or high frequency.

13. Method according to claim 4, further comprising generating a trigger signal by the control component and triggering an ignition element with the trigger signal.

14. An electronic triggering unit for initiating pyrotechnic elements, comprising:

a suppressor circuit;

a programmable microprocessor with integrated program memory, the microprocessor being loaded with a program for generating a trigger signal for triggering an ignition element before use of the triggering unit;

a data coupler for level-adjusting reading of information to the microprocessor and for emitting information generated by the microprocessor;

a rectifier;

a voltage regulator for regulating voltage for the microprocessor;

an energy store for supplying current to ignite an ignition element; and a switch element for receiving a trigger signal from the microprocessor and for triggering an ignition element.

15. The electronic triggering unit according to claim 14, wherein the energy store comprises a capacitor.

16. The electronic triggering unit according to claim 14, wherein the microprocessor is loaded with a program during production of the triggering unit.

17. The electronic triggering unit according to claim 14, further comprising an ignition element operably connected to the switching element.

18. The electronic triggering unit according to claim 14, wherein the data coupler,the rectifier, the voltage regulator and the energy store are integrated in the microprocessor.

* * * * *